US009577378B2

(12) United States Patent
Iida

(10) Patent No.: US 9,577,378 B2
(45) Date of Patent: Feb. 21, 2017

(54) CONNECTOR HAVING A PLURALITY OF FIRST HOUSINGS MATING WITH A SECOND HOUSING ACTUATED BY A LEVER

(71) Applicant: Molex, LLC, Lisle, IL (US)

(72) Inventor: Takashi Iida, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/902,631

(22) PCT Filed: Jul. 2, 2014

(86) PCT No.: PCT/JP2014/067632
§ 371 (c)(1),
(2) Date: Jan. 4, 2016

(87) PCT Pub. No.: WO2015/002222
PCT Pub. Date: Jan. 8, 2015

(65) Prior Publication Data

US 2016/0172788 A1 Jun. 16, 2016

(30) Foreign Application Priority Data

Jul. 2, 2013 (JP) ..... 2013-139289

(51) Int. Cl.
*H01R 13/62* (2006.01)
*H01R 13/629* (2006.01)
*H01R 24/28* (2011.01)
*H01R 13/64* (2006.01)

(52) U.S. Cl.
CPC .. *H01R 13/62938* (2013.01); *H01R 13/62933* (2013.01); *H01R 24/28* (2013.01); *H01R 13/64* (2013.01)

(58) Field of Classification Search
CPC ..... H01R 13/62; H01R 13/62905; H01R 13/62933; H01R 13/62938; H01R 13/62955; H01R 24/28; H01R 23/7005
USPC ..... 439/152, 157, 160
See application file for complete search history.

(56) References Cited

U.S. PATENT DOCUMENTS

| | | | | |
|---|---|---|---|---|
| 5,904,583 | A * | 5/1999 | Katsuma | H01R 13/62933 439/157 |
| 6,309,232 | B1 * | 10/2001 | Okabe | H01R 13/62933 439/157 |
| 6,540,546 | B2 | 4/2003 | Kubo | |
| 6,705,882 | B2 | 3/2004 | Casses | |
| 8,033,844 | B2 | 10/2011 | Kobayashi et al. | |
| 2015/0064953 | A1 * | 3/2015 | Iwatani | H01R 13/62933 439/341 |

(Continued)

FOREIGN PATENT DOCUMENTS

| | | |
|---|---|---|
| JP | 2011-216441 A | 10/2011 |
| JP | 2012-243559 A | 12/2012 |

*Primary Examiner* — Chandrika Prasad
(74) *Attorney, Agent, or Firm* — Clarence R. Moon

(57) ABSTRACT

The connector of the present disclosure is provided with a lever capable of rotating between an unlocked position in which the lever reclines with respect to the insertion direction of a second housing and a locked position in which the lever is upright with respect to the insertion direction of the second housing. The lever is provided with a protruding portion which comes into contact with the edge of an opening in the adjacent first housing before insertion into the second housing has been completed and which causes the lever to approach the locked position.

9 Claims, 11 Drawing Sheets

(56) References Cited

U.S. PATENT DOCUMENTS

2016/0056571 A1* 2/2016 Hamaoka ..... H01R 13/62944
439/638

* cited by examiner

CONNECTOR HAVING A PLURALITY OF FIRST HOUSINGS MATING WITH A SECOND HOUSING ACTUATED BY A LEVER

RELATED APPLICATIONS

This application claims priority to Japanese Application No. 2013-139289, filed Jul. 2, 2013, and to International Application No. PCT/JP2014/067632, filed Jul. 2, 2014, both of which are incorporated herein by reference in their entirety.

FIELD OF THE INVENTION

The present disclosure relates to a connector and, more specifically, to a connector including a lever performing a locking operation.

DESCRIPTION OF RELATED ART

In certain connectors, a lever provided on a plug housing inserted into a receptacle housing is able to rotate between an unlocked position reclined with respect to the insertion direction of the plug housing and a locked position upright with respect to the insertion direction of the plug housing.

BRIEF SUMMARY

However, with connectors with mating assist levers, it is difficult to get a finger on the lever in the unlocked position because the lever is on or near the receptacle housing. When a plurality of receptacle housings are arranged side by side in the background art, the finger often comes into contact with the terminals of the receptacle housings that do not have an installed connector. Therefore, a connector that provides greater access to the operation portion of the lever overcomes the problems of the prior art.

The present disclosure is able to solve this problem by providing a connector comprising: a first housing; a second housing inserted into the first housing; and a lever. This lever is able to rotate around a shaft portion provided on an outside surface of the second housing between an unlocked position reclined with respect to the insertion direction of the second housing and a locked position upright with respect to the insertion direction of the second housing. Either the first housing or the lever is provided with a protruding portion that contacts the other before insertion into the second housing has been completed and causing the lever to approach the locked position.

In an aspect of the present disclosure, the protruding portion is provided on the lever so as to protrude on the side closer to the first housing in the direction of rotation.

Another aspect of the present disclosure, a plurality of first housings are arranged in parallel, and the protruding portion contacts an edge of an opening in the first housing adjacent to the first housing receiving the inserted second housing among the plurality of first housings.

Another aspect of the present disclosure, the lever comprises: a pair of arm portions arranged so as to interpose the second housing; and a bridge portion spanning the space between the tips of the pair of arm portions; the protruding portion being provided on one of the pair of arm portions.

Another aspect of the present disclosure, the lever comprises: a pair of arm portions arranged so as to interpose the second housing; and a bridge portion spanning the space between the tips of the pair of arm portions; a finger rest portion being provided on the bridge portion so as to project radially on the side farther from the first housing in the direction of rotation.

Another aspect of the present disclosure, an engaging groove is formed in the lever to engage an engaging piece provided on an outer surface of the first housing, and the engaging piece is able to become detached from the engaging groove in the insertion/detachment direction of the second housing at the position of the lever when insertion of the second housing has been completed.

Another aspect of the present disclosure, an engaging piece is provided on each of the second housing and the lever that engages each other restricting rotation of the lever towards the locked position of the lever when the lever is in the unlocked position, contact with the protruding portion causing the engaging pieces to overcome each other and the lever to advance toward the locked position when the second housing is inserted.

In the present disclosure, contact with the protruding portion when the second housing is inserted causes the lever to advance toward the locked position, making it easier to get a finger on the lever and reducing the distance required for operating the lever.

DETAILED DESCRIPTION

The following is an explanation of a connector in an embodiment of the present disclosure with reference to the drawings.

Figure 1A:
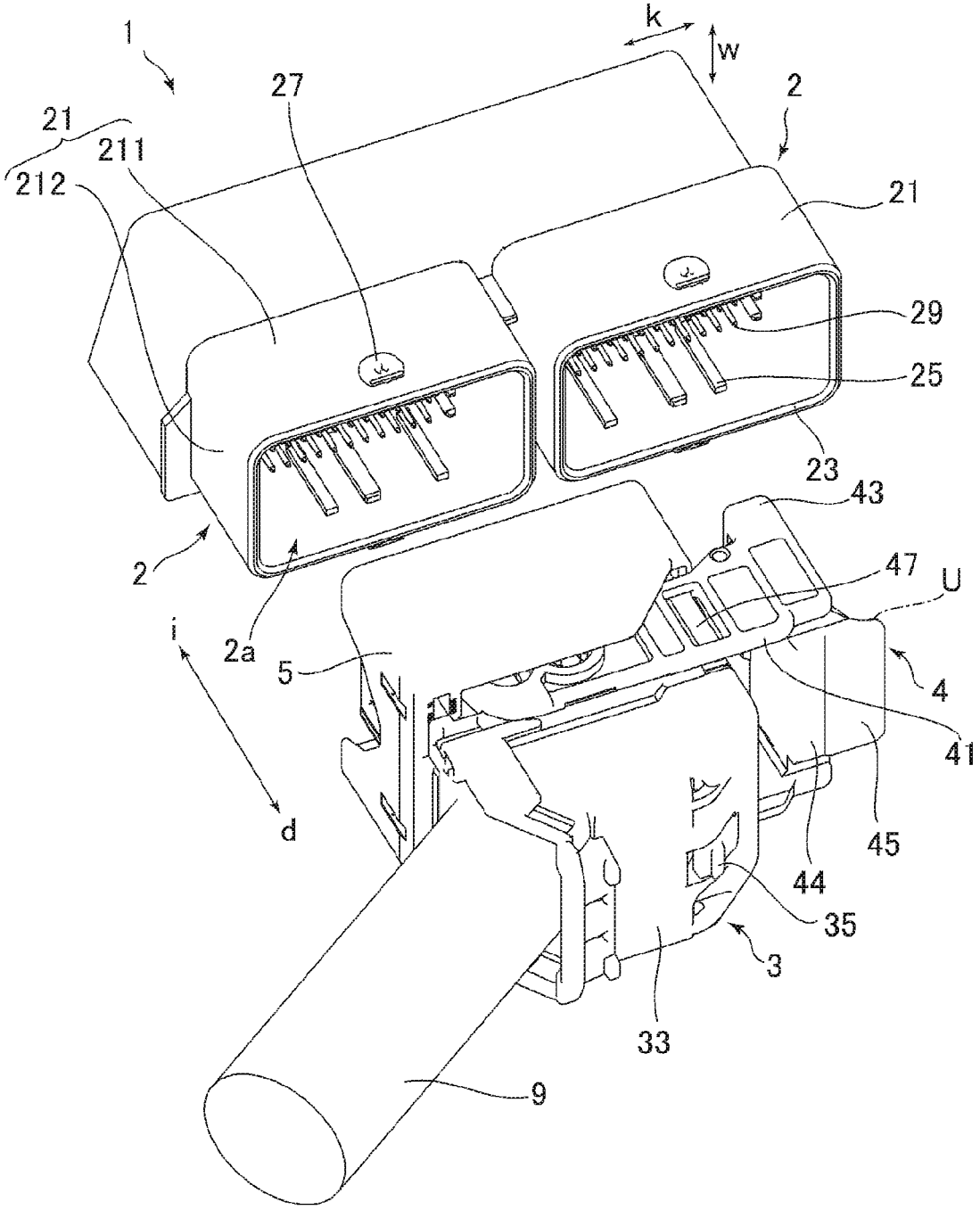
FIG. 1A is a perspective view of a connector in an embodiment of the present disclosure.
Figure 1B:
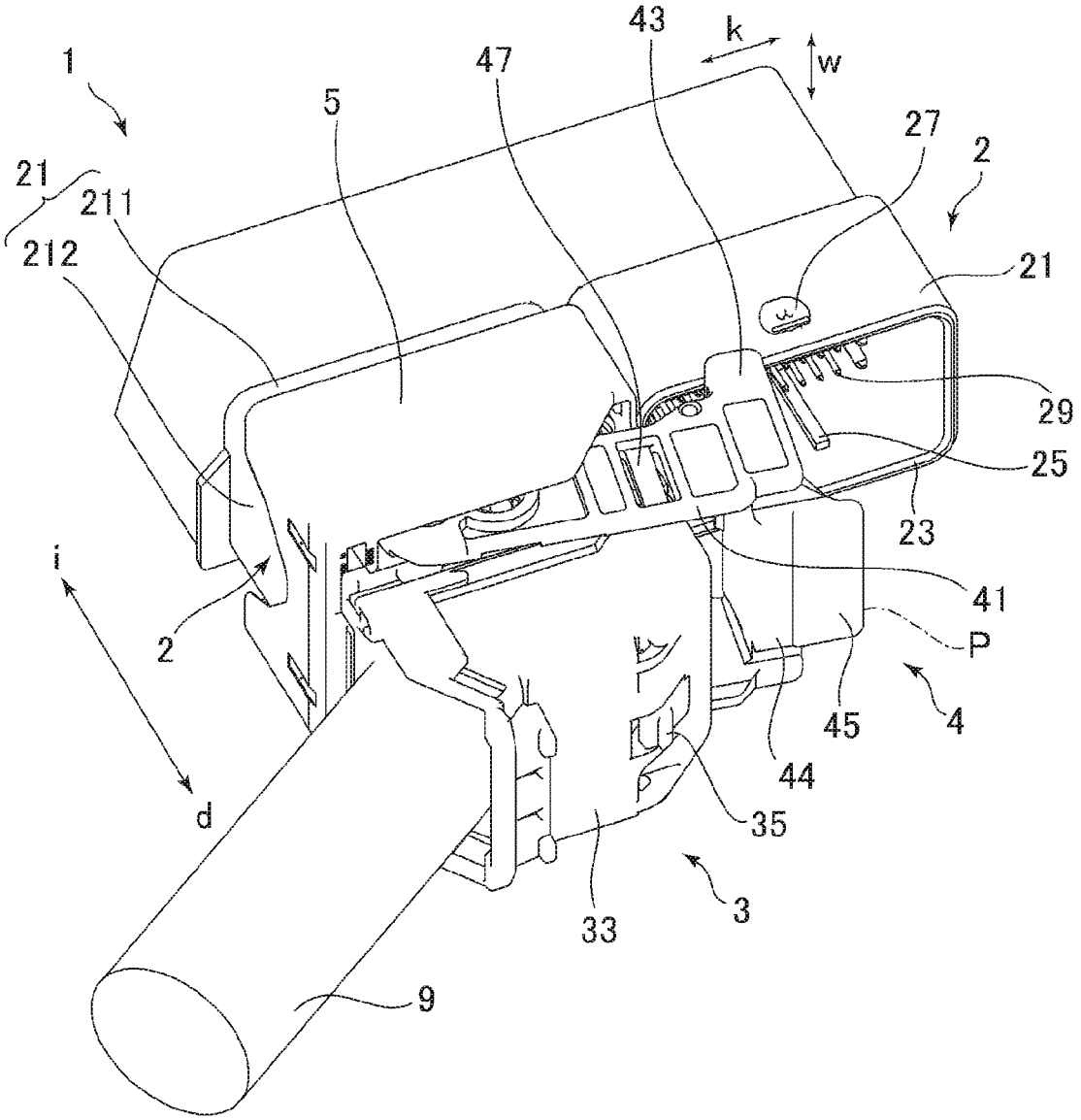
FIG. 1B is a perspective view of the same connector.
Figure 1C:
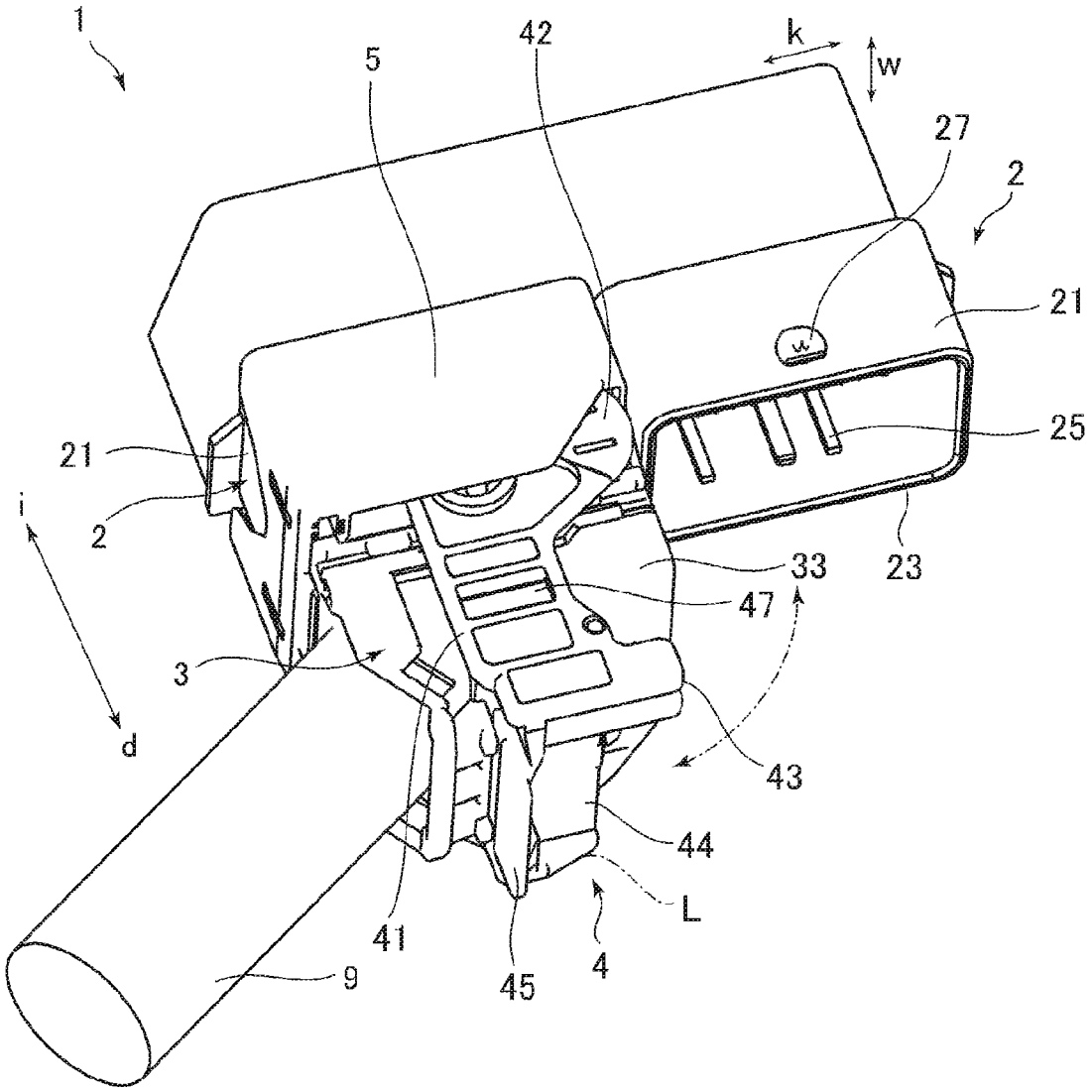
FIG. 1C is a perspective view of the same connector.
Figure 2:
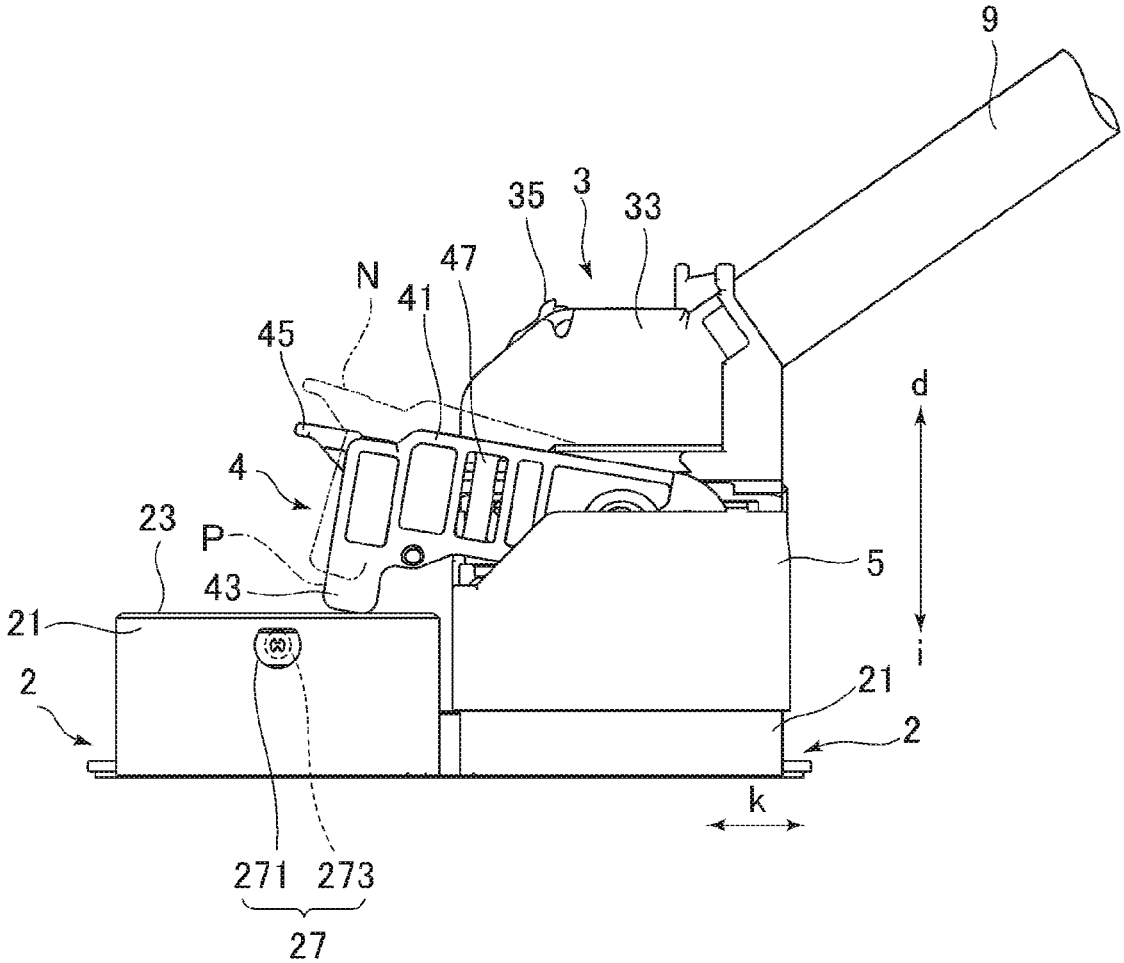
FIG. 2 is a side view of the same connector.
Figure 3:
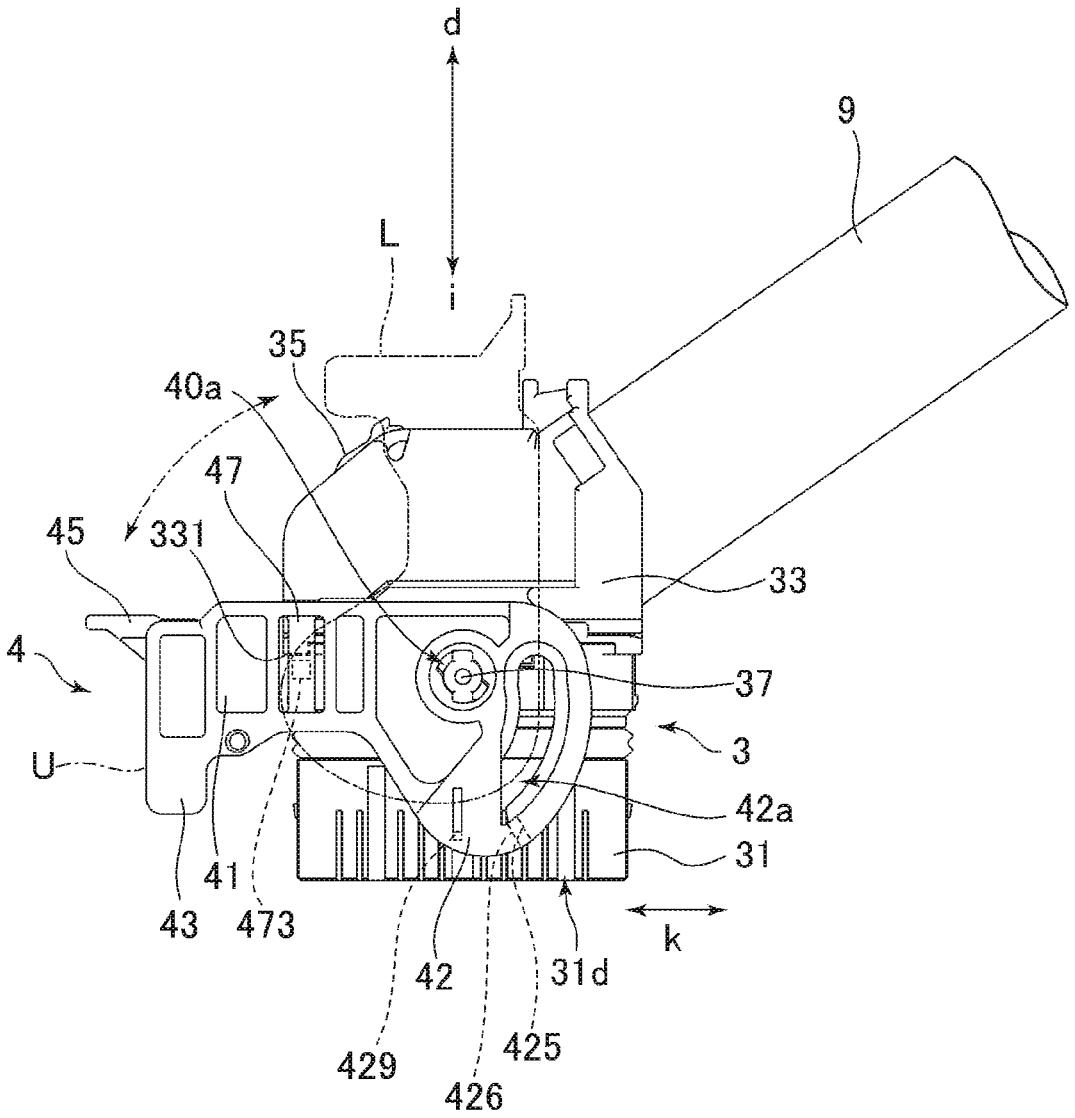
FIG. 3 is a side view of the second housing and the lever in the same connector.
Figure 4A:
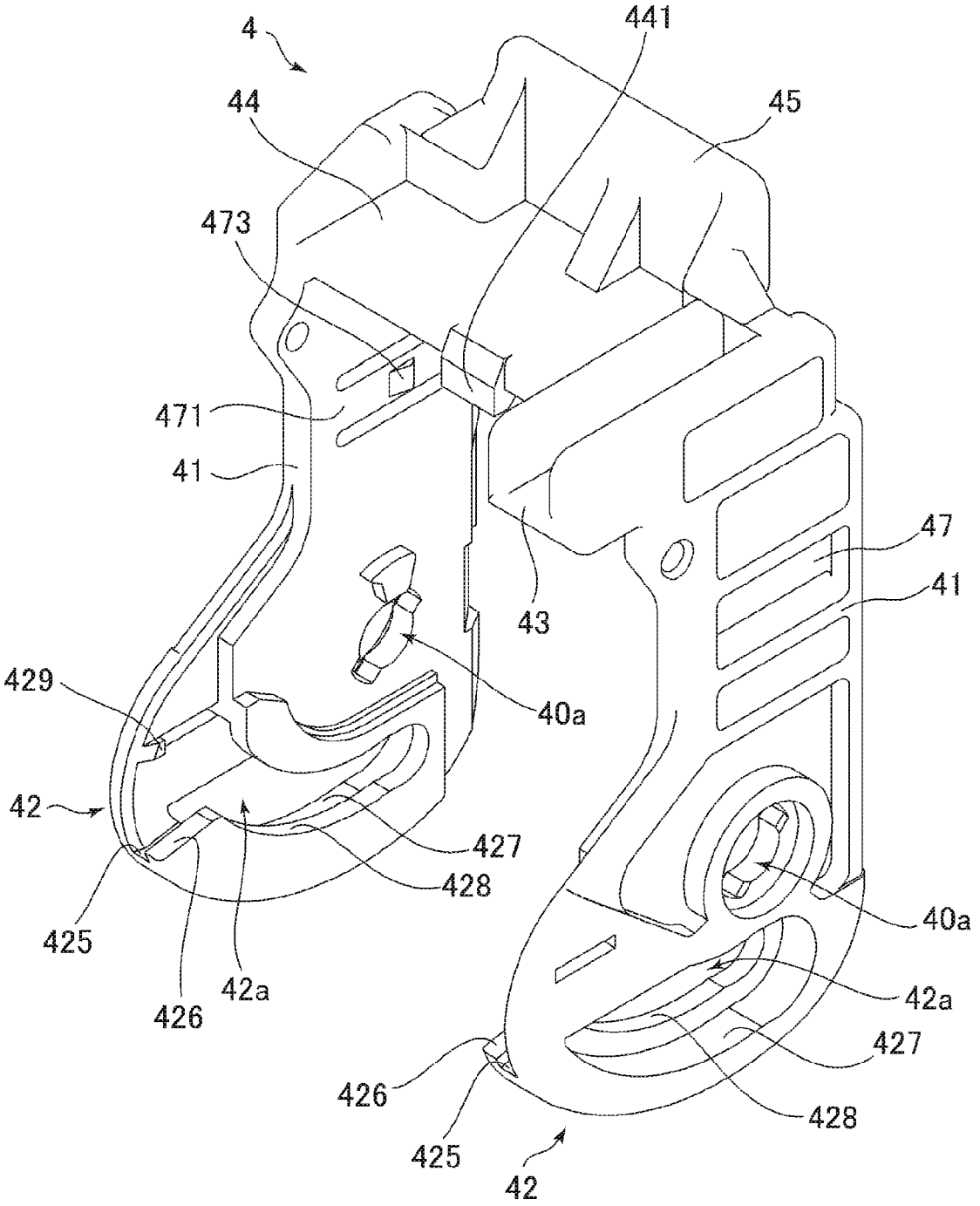
FIG. 4A is a perspective view of the lever in the same connector.
Figure 4B:
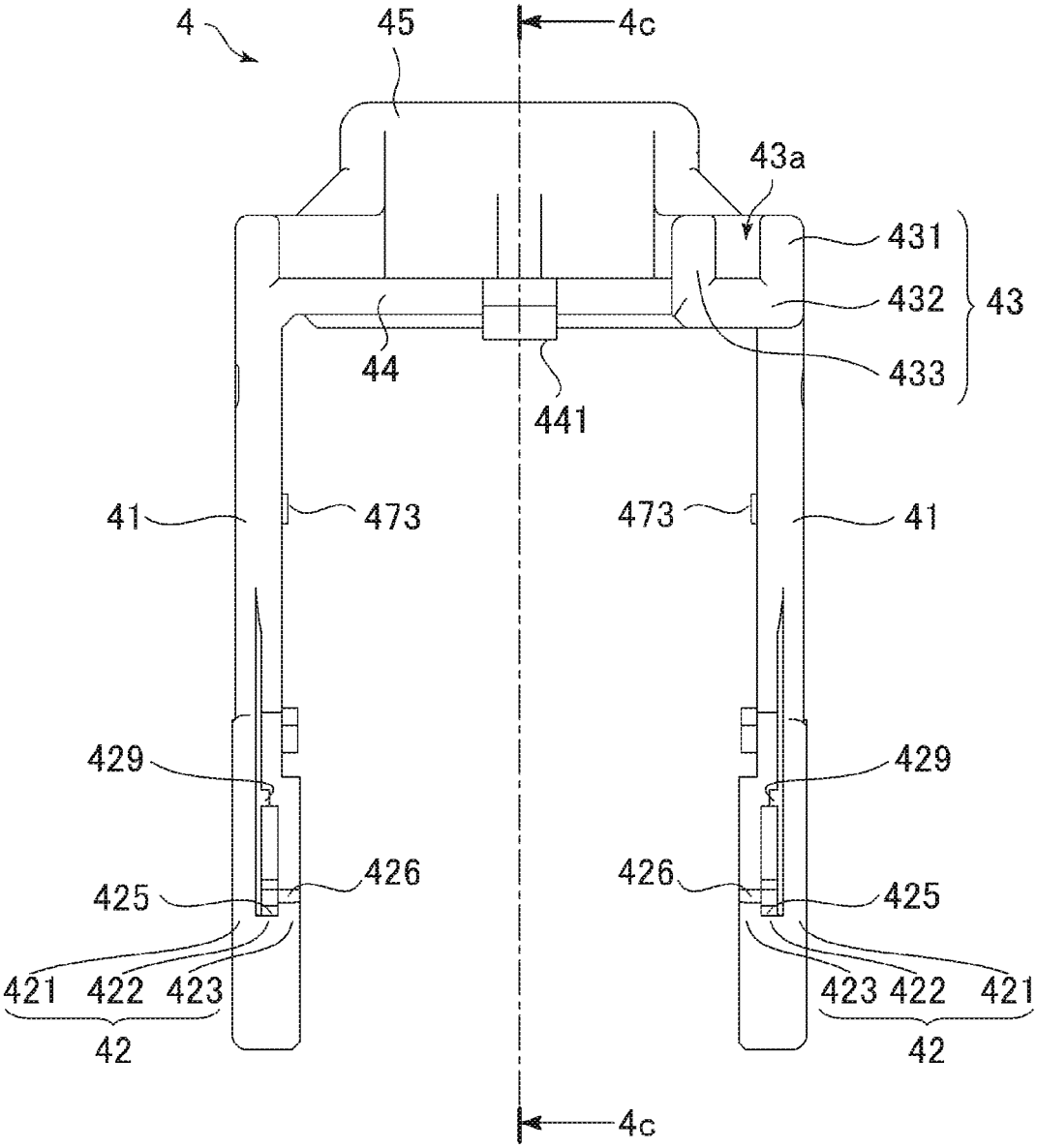
FIG. 4B is a front view of the lever in the same connector.
Figure 4C:
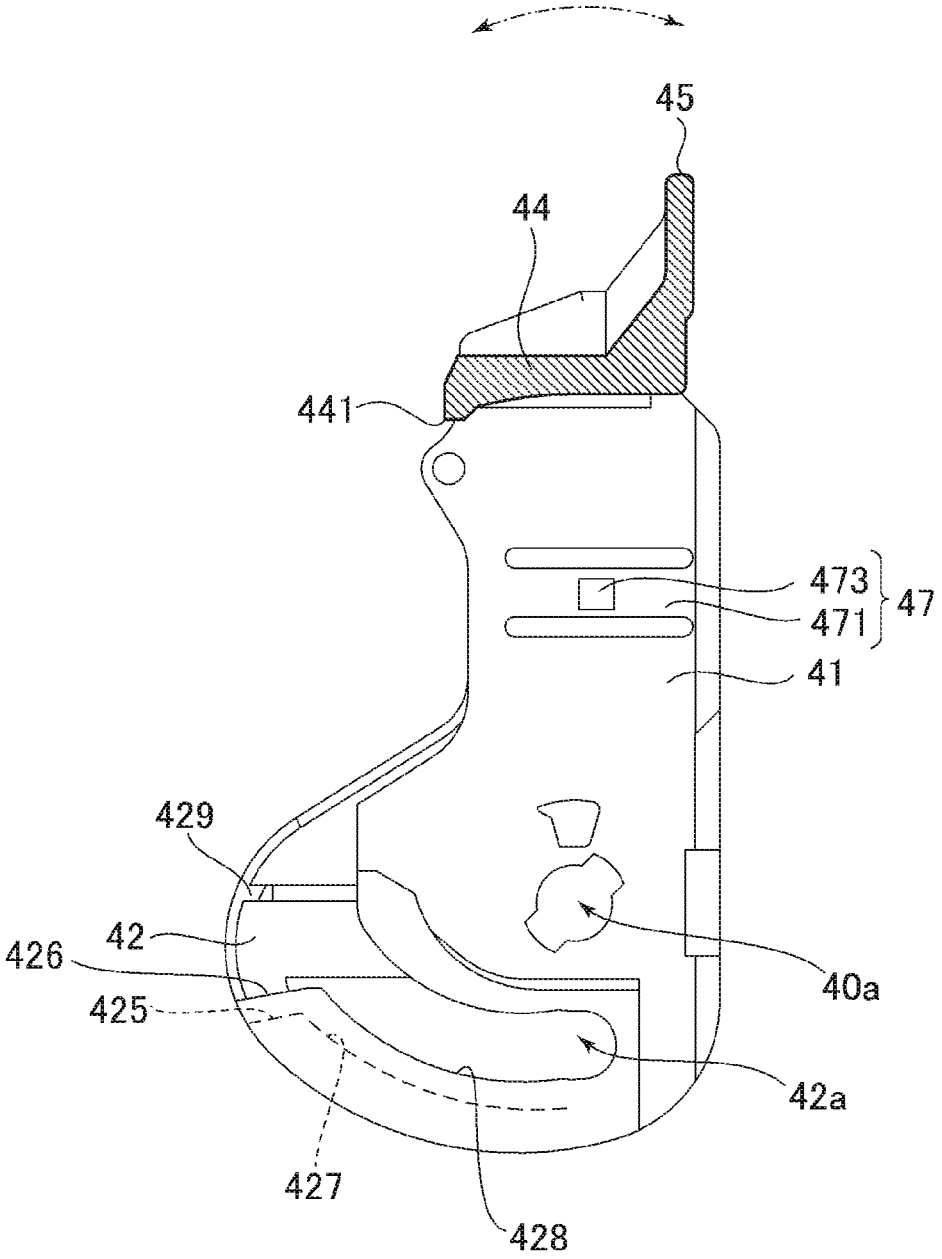
FIG. 4C is a cross-sectional view of the lever in the same connector.

FIG. 1A through FIG. 1C are perspective views of a connector 1 in an embodiment of the present disclosure. FIG. 2 is a side view of the connector 1. FIG. 1A shows the configuration before the second housing 3 has been inserted into the first housing 2, FIG. 1B and FIG. 2 show the configuration after the second housing 3 has been inserted into the first housing 2. FIG. 1C shows the situation when the lever 4 has been rotated to the locked position L after the second housing 3 has been inserted into the first housing 2. FIG. 3 is a side view of the second housing 3 and the lever 4 in the connector 1. FIG. 3 shows the lever 4 at the unlocked position U. FIG. 4A through FIG. 4C are a perspective view, front view, and cross-sectional view of the lever 4.

Here, the solid-line arrow id in FIG. 1A through FIG. 3 indicates the insertion/detachment direction of the second housing 3. In the insertion/detachment direction id, i indicates the insertion side and d indicates the detachment side.

Solid-line arrow k and solid-line arrow w in FIG. 1A through FIG. 3 indicate the long-axis direction and short-axis direction of the first housing 2 intersecting the insertion/detachment direction id. The dashed-line arrow in FIG. 1C and FIG. 3 indicate the turning direction of the lever 4.

The connector 1 includes a plurality of receptacle first housings 2, a plurality of plug second housings 3 inserted into the first housings 2, a lever 4 rotatably supported on each second housing 3, and a cover 5 attached to each second housing 3. In FIG. 1A through FIG. 2, only one second housing 3 is shown. FIG. 3 shows a second housing 3 and a lever 4 with the cover 5 removed.

The first housing 2 includes an angular tube-shaped outer shell 21. A plurality of terminals 29 extending towards the detachment side d are held in the outer shell 21. The outer shell 21 includes a pair of long panel portions 211 facing the short-axis direction w and extending in the long-axis direction k, and a pair of short panel portions 212 facing the long-axis direction k and extending in the short-axis direction w. An opening 2*a* on the detachment side d is formed in the outer shell 21, and the edge 23 of the opening 2*a* has a rectangular frame-shaped profile in a plan view including the long-axis direction k and the short-axis direction w.

A ridge portion 25 is provided on the inner peripheral surface of the long panel portion 211 of the outer shell 21 which extends in the insertion/detachment direction id. An engaging piece 27 that engages a lever 4 provided on the outer peripheral surface of the long panel portion 211 of the outer shell 21. The engaging piece 27 has a disk-shaped large diameter portion 271, and a small diameter portion 273 with a diameter smaller than that of the large-diameter portion 271 positioned between the long panel portion 211 and the large-diameter portion 271 (see FIG. 2).

The plurality of first housings 2 are arranged in parallel in the long-axis direction k. In the present embodiment, two first housings 2 are adjacent to each other in the long-axis direction k. However, the present disclosure is not limited to this configuration. For example, three or more first housings 2 may be arranged in parallel in the long-axis direction k.

The second housing 3 includes an angular column-shaped inserted portion 31 inserted into the first housing 2. A plurality of terminals not shown in the drawing are held in the inserted portion 31 (see FIG. 3). When the inserted portion 31 is inserted into a first housing 2, the terminals (not shown) held in the inserted portion 31 make contact with the terminals 29 held in the first housing 2. The terminals (not shown) held in the inserted portion 31 are connected to a wire harness 9 extending from the second housing 3.

An angular tube-shaped cover 5 is attached to the second housing 3 and positioned so as to surround the inserted portion 31. When an inserted portion 31 is inserted into the first housing 2, the cover 5 is positioned so as to surround the first housing 2. In other words, when the inserted portion 31 is inserted into the first housing 2, the first housing 2 is inserted into the gap between the inserted portion 31 and the cover 5.

A recessed portion 31*d* extending in the insertion/detachment direction id is provided on the outer peripheral surface of the inserted portion 31 in a position corresponding to the ridge portion 25 on the first housing 2. When the inserted portion 31 is inserted into the first housing 2, the ridge portion 25 on the first housing 2 is fitted into the recessed portion 31*d* to guide the inserted portion 31 in the insertion/detachment direction id.

A backside cover 33 is arranged on the detachment side d of the inserted portion 31 so as to surround the connection with the wire harness 9. The backside cover 33 is open on one end on the long-axis direction k, and the wire harness 9 protrudes towards the detachment side d in the insertion/detachment direction id from the one side of the backside cover 33 in the long-axis direction k.

An engaging piece 35 protruding towards the detachment side d is provided on the detachment side d of the backside cover 33 in order to keep the lever 4 in the locked position L. An engaging piece 331 is also provided between the inserted portion 31 and the backside cover 33 to keep the lever 4 in the unlocked position U (see FIG. 3). An engaging piece 331 is provided on both sides in the short-axis direction w on the other end in the long-axis direction k.

A shaft portion 37 protruding in the short-axis direction w is provided between the inserted portion 31 and the backside cover 33 in order to rotatably support the lever 4. A shaft portion 37 is provided on both sides in the short-axis direction w in the central portion in the long-axis direction k. The tips of the shaft-portions 37 overhang in the insertion/detachment direction id and have a substantially Φ-shaped profile.

The lever 4 is able to rotate around the shaft portion 37 provided on the second housing 3 between an unlocked position U and a locked position L, and is used to secure a fitted first housing 2 and second housing 3 to each other. The lever 4 has a substantially U-shaped profile when viewed from the front (see FIG. 4B), and has a substantially L-shaped profile when viewed from the side (see FIG. 4C).

The lever 4 includes a pair of plate-like arm portions 41 extending parallel to each other. This pair of arm portions 41 are arranged so as to interpose the second housing 3. A shaft hole 40*a* is formed in the base end of the arm portions 41 that receive the shaft portions 37 of the second housing 3. The shaft holes 40*a* have a substantially Φ-shaped profile enabling the inserted tips of the shaft portions 37 to be received.

A plate-like bridge portion 44 spans the tips of the pair of arm portions 41. The bridge portion 44 is arranged so as to be orthogonal to the radial direction centered on the shaft holes 40*a*. The tips of the arm portions 41 protrude towards the tip side with respect to the bridge portion 44 in the radial direction.

An engaging piece 441 is provided in the bridge portion 44 on the side nearer the unlocked position U in the turning direction (that is, on the side closer to the first housing 2) and protrudes towards the base side in the radial direction. The engaging piece 441 meshes with the engaging piece 35 on the second housing 3 to keep the lever 4 in the locked position L.

A plate-like finger rest portion 45 is provided in the bridge portion 44 on the side nearer the locked position L in the turning direction (that is, on the side farther from the first housing 2) and overhangs in the tip side in the radial direction. The finger rest portion 45 is arranged so as to be orthogonal to the turning direction and is continuous with the tip of the arm portions 41. The operator places a finger on the finger rest portion 45 to operate the lever 4.

A protruding portion 43 is provided on one side of the tips of the pair of arm portions 41 on the side nearer the unlocked position U in the turning direction (that is, on the side closer to the first housing 2). A section of the protruding portion 43 connects the arm portion 41 to the bridge portion 44.

The protruding portion 43 has a contact portion 432 making contact with the other protruding portion, and two reinforcing portions 431, 433 provided on the tip side of the contact portion 432 in the radial direction and extending linearly in the turning direction. A groove 43*a* extending linearly in the turning direction is provided between the two reinforcing portions 431, 433. The contact portion 432 is continuous on the same plane as the bridge portion 44, and the reinforcing portions 431 are continuous on the same plane as the arm portions 41.

By providing reinforcing portions 431, 433 on the tip side of the contact portion 432 in the radial direction, the rigidity of the contact portion 432 can be improved. By dividing the reinforcing portions 431, 433 with grooves 43*a* at intervals, the contact width of the contact portion 432 can be increased.

An engaging portion 47 is provided in the middle of an arm portion 41 in the direction of extension in order to keep the lever 4 in the unlocked position U. The engaging portion 47 includes a band-like elastic beam 471 extending linearly in the turning direction and an engaging piece 473 protruding to the inside of the elastic beam 471 (that is, on the side with the second housing 3). The elastic beam 471 is disconnected from the arm portion 41 in the radial direction to provide elasticity in the thickness direction. The engaging piece 473 meshes with the engaging piece 331 on the second housing 3 to keep the lever 4 in the unlocked position U.

The lever 4 includes a band-like acting portion 42 protruding radially around the shaft hole 4 in the direction different from the extension direction of the arm portion 41. In the present embodiment, the acting portion 42 protrudes in the same direction as the protruding portion 43, that is, in a direction orthogonal to the extension direction of the arm portion 41. The acting portion 42 protrudes farther than the protruding portion 43 in the direction orthogonal to the extension direction of the arm portion 41.

A slit-like engaging groove 42*a* is provided in the acting portion 42 to engage an engaging piece 27 on the first housing 2. The engaging piece 27 is guided in the direction of the engaging groove 42*a* and prevents movement in any other direction. The engaging groove 42*a* extends from the tip of the acting portion 42 in a curved direction opposite the arm portion 41 including the shaft hole 40*a*. The engaging groove 42*a* has a trajectory which gradually approaches the shaft hole 40*a* as it moves away from the tip of the acting portion 42.

More specifically, the acting portion 42 has a three-layered structure including an outer portion 421, a middle portion 422, and an inner portion 423. The outer portion 421 and the middle portion 422 have a guiding edge 427 forming a portion of the engaging groove 42*a*, and the large diameter portion 271 of the engaging piece 27 on the first housing 2 is fitted against this guiding edge 427. The inner portion 423 has a guiding edge 428 forming another portion of the engaging groove 42*a*, and the small diameter portion 273 of the engaging piece 27 on the first housing 2 is fitted against this guiding edge 428.

Receiving edges 425, 426 are provided in the middle portion 422 and the inner portion 423 that receives the engaging piece 27 of the first housing 2 into the engaging groove 42*a* at the tip of the acting portion 42. The receiving edges 425, 426 extend in the protruding direction of the acting portion 42 and are continuous with the guiding edges 427, 428.

A protruding portion 429 is provided in the outer portion 421 on the inside of the acting portion 42 (that is, on the side with the second housing 3) at the tip of the acting portion 42. The large diameter portion 271 of the engaging piece 27 provided on the first housing 2 is inserted into the engaging groove 42*a* in the gap between the receiving edge 425 and the protruding portion 429.

The lever 4 is able to rotate around the shaft portion 37 on the second housing 3 inserted into the shaft hole 40*a* between the unlocked position U and the locked position L (see FIG. 1A through FIG. 3).

In the unlocked position U, the lever 4 is reclined with respect to the insertion/detachment direction id. More specifically, the extension direction of the arm portion 41 of the lever 4 is relatively close to the long-axis direction k orthogonal to the insertion/detachment direction id at the unlocked position U. In the present embodiment, the extension direction of the arm portion 41 is parallel to the long-axis direction k orthogonal to the insertion/detachment direction id in the unlocked position U. Also, in the unlocked position U, the tip of the arm portion 41 is positioned opposite the wire harness 9 extending from the backside cover 33 in the long-axis direction k. Also, in the unlocked position U, the acting portion 42 of the lever 4 protrudes on the insertion side i.

In the locked position L, the lever 4 is reclined with respect to the insertion/detachment direction id. More specifically, the extension direction of the arm portion 41 of the lever 4 is relatively close to the insertion/detachment direction id at the locked position L. In the present embodiment, the extension direction of the arm portion 41 is parallel to the insertion/detachment direction id in the locked position L. Also, in the locked position L, the tip of the arm portion 41 is positioned on the detachment side d. Also, in the locked position L, the acting portion 42 of the lever 4 protrudes opposite the wire harness 9 extending from the backside cover 33 in the long-axis direction k.

The following is an explanation of the series of operations performed to insert the second housing 3 into the first housing 2 and to secure the housings using the lever 4.

Before the second housing 3 is inserted, the lever 4 is in the unlocked position U (see FIG. 1A and FIG. 3). In other words, the extension direction of the arm portion 41 of the lever 4 is parallel to the long-axis direction k orthogonal to the insertion/detachment direction id, and the protruding portion 43 on the tip of the arm portion 41 protrudes on the insertion side i. The acting portion 42 of the lever 4 also protrudes on the insertion side i, and the gap between the receiving edge 425 and the protruding portion 429 opens on the insertion side i. In the present disclosure, the extension direction of the insertion edges 425, 426 is on a slight incline away from the insertion/detachment direction id on the insertion side i.

When the lever 4 is in the unlocked position U, the second housing 3 is moved towards the first housing 2 on the insertion side i and begins to be inserted (see FIG. 1A).

While the second housing 3 is being inserted, the engaging piece 27 on the first housing 2 enters the engaging groove 42*a* via the gap between the insertion edge 425 and the protruding portion 429 on the acting portion 42 of the lever 4 (see FIG. 3). In addition, the protruding portion 43 of the lever 3 contacts the edge 23 of the opening 2*a* in the first housing 2 adjacent to the first housing 2 receiving the inserted second housing 3 (see FIG. 1B).

In the present embodiment, the protruding portion 43 of the lever 4 contacts the edge 23 of the opening 2*a* in the first housing 2 adjacent to the first housing 2 receiving the inserted second housing 3 on the side including the tip of the arm portion 41 in the long-axis direction k. More specifically, the protruding portion 43 of the lever 4 contacts one of the pair of sides on the edge 23 of the opening 2*a* in the adjacent first housing 2 facing the short-axis direction w and extending in the long-axis direction k.

In the protruding portion 43 of the lever 4, the reaction to the force used to insert the second housing 3 is received by the edge 23 of the opening 2*a* in the adjacent first housing 2. The force of the reaction acts in the direction turning the lever 4 towards the locked position L.

When the lever 4 is in the unlocked position U, the engaging piece 331 on the second housing 3 engages the engaging piece 473 on the lever 4 to restrict turning of the lever 4 to the locked position L (see FIG. 3). When the force of reaction is applied to the lever 4, the engaging pieces 331, 473 overcome each other and the lever 4 begins to turn towards the locked position L.

When the second housing 3 has been inserted, the lever 4 is pressed on the detachment side d by the edge 23 of the opening 2*a* in the adjacent first housing 2. As a result, the lever moves to interim position P between the unlocked position U and the locked position L (see FIG. 1B and FIG. 2). When the second housing 3 has been inserted, the interim position P is the position at which the protruding portion 43 of the lever 4 comes into contact with the edge 23 of the opening 2*a* in the adjacent first housing 2.

When the second housing 3 has been inserted, the lever 4 moves to the interim position P, and the gap between the edge 23 of the opening 2*a* in the adjacent first housing 2 and the finger rest portion 45 of the lever 4 increases. This makes it easier for the operator to place a finger on the finger rest portion 45 of the lever 4, and reduces the distance over which the lever 4 is operated. It also keeps the finger of the operator from coming into contact with the terminals 29 held in the adjacent first housing 2. As a result, the lever 4 is easier to operate.

When the lever 4 is in the interim position P in the present embodiment, the extension direction of the receiving edges 425, 426 is parallel to the insertion/detachment direction id. In other words, when the lever 4 is in the interim position P, the engaging piece 27 on the first housing 2 is able to pass through the gap between the receiving edge 425 on the acting portion 42 of the lever 4 and the protruding portion 429.

The force of reaction acting on the lever 4 so as to cause the engaging pieces 331, 473 to overcome each other depends on the degree to which the engaging piece 331 on the second housing 3 and the engaging piece 473 on the lever 4 engage each other and the degree to which the elastic beam 471 holding engaging piece 331 is elastic. However, sometimes the momentum turns the lever 4 from the interim position P to a position N near the locked position L (see FIG. 2). At this time, the lever 4 becomes easier to operate because the gap between the edge 23 of the opening 2*a* in the adjacent first housing 2 and the finger rest position 45 of the lever 4 increases.

After the second housing 3 has been inserted, the operator places a finger on the finger rest portion 45 of the lever 4 which has moved to the interim position P to turn the lever 4 from the interim position P to the locked position L (see FIG. 1C). In this way, the first housing 2 and the second housing 3 are secured to each other. In other words, by turning the lever 4 to the locked position L, the engaging piece 27 of the first housing 2 is held inside the engaging groove 42*a* in the lever 4 to restrict movement in the insertion/detachment direction id.

Because, in the present embodiment, the finger rest portion 45 is positioned closer to the locked position L in the turning direction of the lever 4 (that is, away from the first housing 2), the finger of the operator used to operate the lever 4 is farther away from the first housing 2. This can keep the finger of the operator from coming into contact with the terminals 29 held in the adjacent first housing 2.

When the lever 4 is moved towards the interim position P from the locked position L, the second housing 3 can be detached from the first housing 2. Because the extension direction of the receiving edges 425, 426 is parallel to the insertion/detachment direction id when the lever 4 is in the interim position P, the engaging piece 27 on the first housing 2 can be easily detached from the engaging groove 42*a* via the gap between the receiving edge 425 on the acting portion 42 of the lever 4 and the protruding portion 429.

Figure 5A:
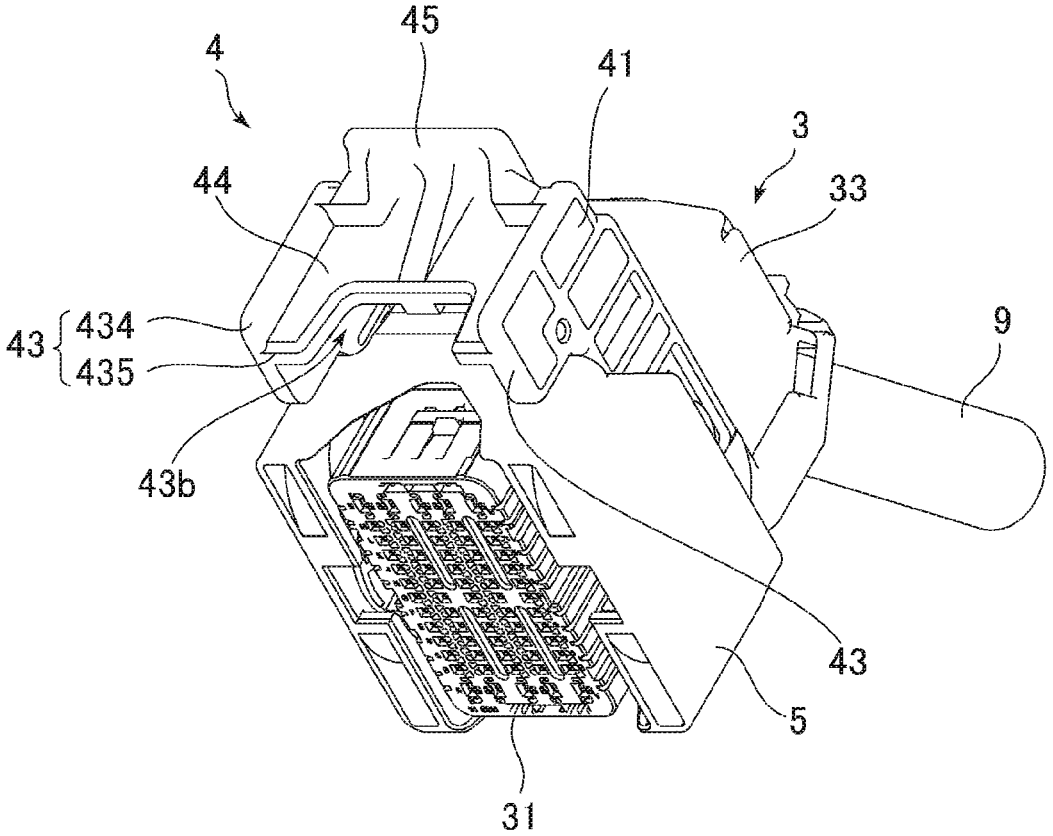
FIG. 5A is a perspective view of a connector in another embodiment of the present disclosure.
Figure 5B:
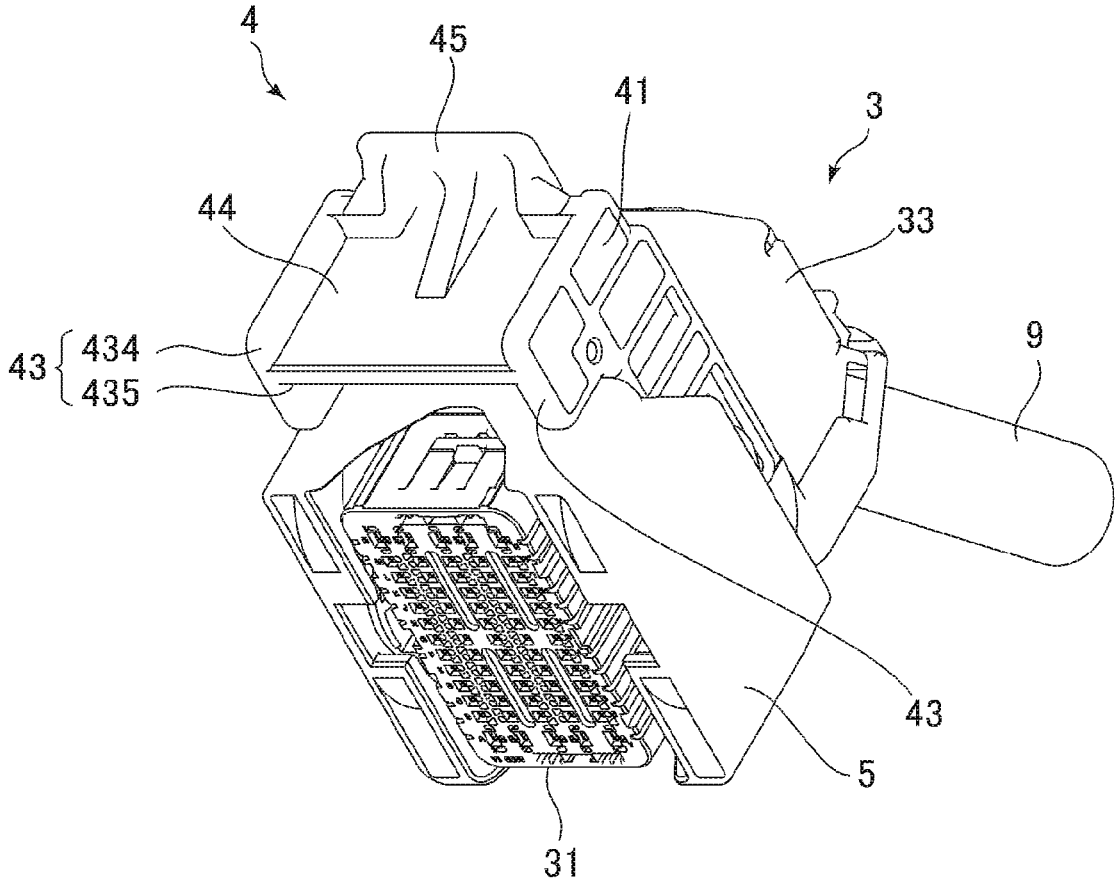
FIG. 5B is a perspective view of a connector in another embodiment of the present disclosure.
Figure 6:
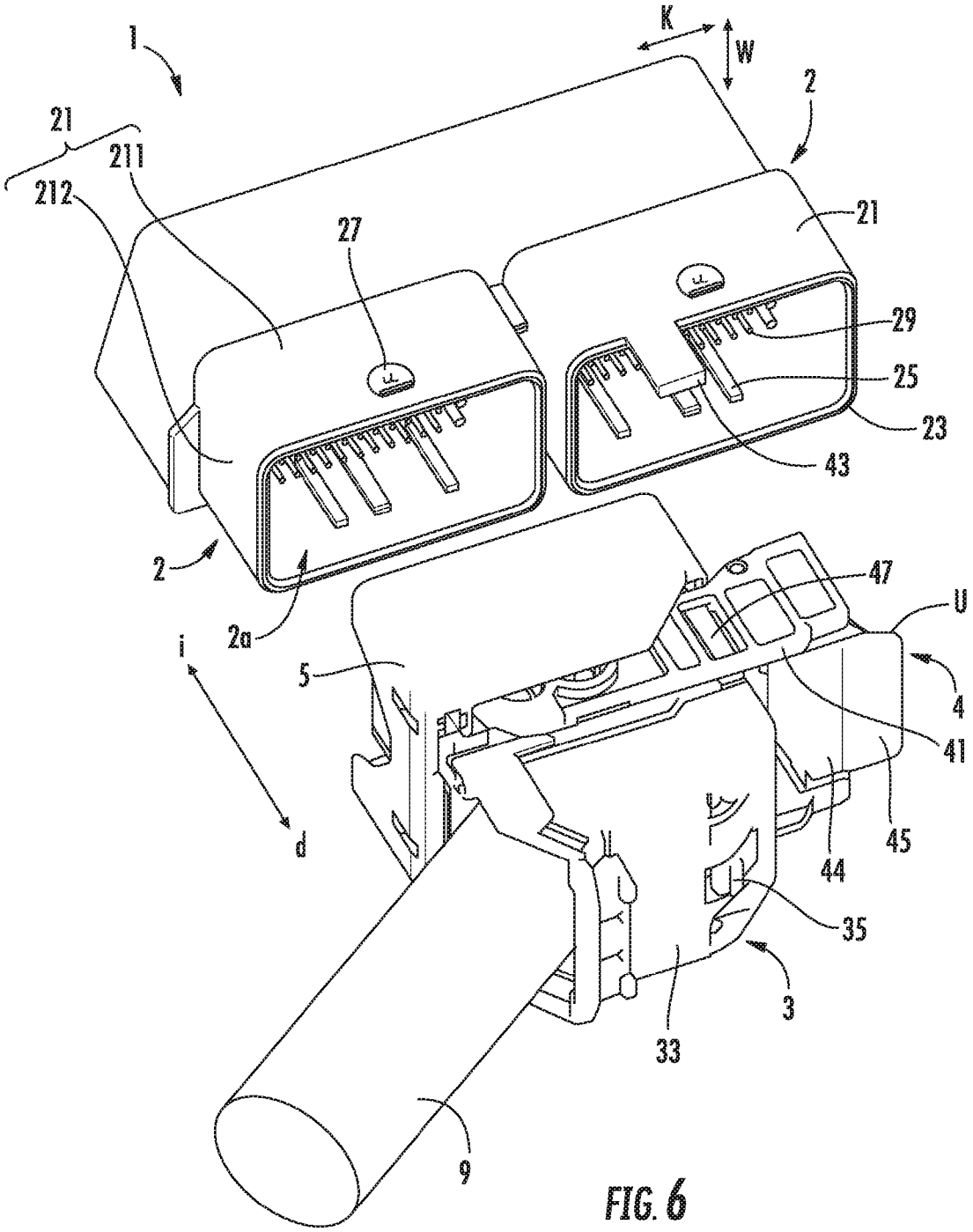
FIG. 6 is a perspective view of a connector in another embodiment of the present disclosure.

FIG. 5A and FIG. 5B are perspective views of connectors 1 in other embodiments of the present disclosure. The components and structures identical to those in the embodiment described above are denoted by the same reference numbers and further description of these components and structures has been omitted.

In the example shown in FIG. 5A, a protruding portion 43 is provided on the tip of both arm portions 41, and a notch 43*b* is formed between the two protruding portions 43. Each protruding portion 43 has a contact portion 435 continuing on the same plane as the bridge portion 44 and a reinforcing portion 434 continuing on the same plane as the arm portion 41. The two protruding portions 43 contact both edges 23 in the opening 2*a* in the adjacent first housing 2 facing the short-axis direction w and extending in the long-axis direction k. In the example shown in FIG. 5B, a notch is not formed but the contact portion 435 is larger in the width direction.

The present disclosure is not limited to the embodiments of the present disclosure described above. A person skilled in the art could certainly devise modifications and improvements within the spirit and scope of the present disclosure.

In the embodiment described above, a plurality of first housings 2 are provided, and the protruding portion 43 of the lever 4 comes into contact with an edge 23 of the opening 2*a* in the first housing 2 other than the first housing 2 receiving the inserted housing. However, the present disclosure is not limited to this embodiment. For example, there can be a single first housing 2 and the protruding portion 43 of the lever 4 can come into contact with an integrally provided contacted portion.

In the embodiment described above, the protruding portion 43 of the lever 4 comes into contact with an edge 23 of the opening 2*a* in a first housing 2 adjacent to the first housing 2 receiving the inserted housing in the long-axis direction k. However, the present disclosure is not limited to this embodiment. For example, the protruding portion 43 of the lever 4 may come into contact with an edge 23 of the opening 2*a* in the adjacent first housing 1 in the short-axis direction w or in an oblique direction.

In the embodiment described above, a protruding portion 43 is provided on the lever 4. However, the present disclosure is not limited to this embodiment. For example, a protruding portion may be integrally formed in the first housing 2 to make contact with the arm portion 41 or bridge portion 44 of the lever 4.

The invention claimed is:

1. A connector comprising:

a plurality of first housings;

a second housing configured to be inserted into the first housing along an insertion direction, a lever mounted around a shaft portion provided on an outside surface of the second housing configured to move in a rotational direction between an unlocked position reclined with respect to the insertion direction of the second housing and a locked position upright with respect to the insertion direction of the second housing; and wherein a protruding portion is formed on a one of the first housings or the lever and configured to contact another of the first housings or the lever before complete insertion of the second housing into the first housing and causing the lever to approach the locked position.

2. The connector according to claim 1, wherein the protruding portion is provided on a side surface of the lever and extends along the direction of rotation.

3. The connector according to claim 2, wherein the side surface is positioned closer to the first housing along the direction of rotation.

4. The connector according to claim 3, wherein the plurality of first housings are arranged in parallel, and the protruding portion contacts an edge of an opening of a first housing that is adjacent to the first housing receiving the inserted second housing.

5. The connector according to claim 4, wherein the lever comprises:

a pair of arm portions arranged so as to interpose the second housing including a bridge portion spanning the arm portions, and the protruding portion provided on one of the pair of arm portions.

6. The connector according to claim 5, wherein a finger rest portion is provided on the bridge portion and projects radially on a side surface of the bridge portion opposite the protruding portion and along the direction of rotation.

7. The connector according to claim 1, wherein the lever comprises:

a pair of arm portions arranged so as to interpose the second housing including a bridge portion spanning the arm portions, the protruding portion provided on one of the pair of arm portions includes a finger rest portion provided on the bridge portion that projects radially from a side surface of the bridge portion opposite the protruding portion and along the direction of rotation.

8. The connector according to claim 1, wherein an engaging groove is formed in the lever to engage an engaging piece provided on an outer surface of the first housing, and the engaging piece is engaged or disengaged from the engaging groove in the insertion/detachment direction when insertion of the second housing has been completed.

9. The connector according to claim 1, wherein an engaging piece is provided on each of the second housing and the lever that engage each other restricting rotation of the lever towards the locked position of the lever when the lever is in the unlocked position, upon contact of the protruding portion with the first housing during the insertion of the second housing the engaging pieces disengage each other and allow the lever to reach the locked position.

* * * * *